US011426672B1

(12) United States Patent
Hwang et al.

(10) Patent No.: US 11,426,672 B1
(45) Date of Patent: Aug. 30, 2022

(54) RECONFIGURABLE TOY VEHICLE TRACK SET

(71) Applicant: Mattel, Inc., El Segundo, CA (US)

(72) Inventors: Jung Jun Hwang, Inglewood, CA (US); Tsz Kin Lim, Yuen Long (HK)

(73) Assignee: MATTEL, INC., El Segundo, CA (US)

( * ) Notice: Subject to any disclaimer, the term of this patent is extended or adjusted under 35 U.S.C. 154(b) by 0 days.

(21) Appl. No.: 17/584,681

(22) Filed: Jan. 26, 2022

(51) Int. Cl.
*A63H 18/06* (2006.01)
*A63H 18/02* (2006.01)
*A63H 33/00* (2006.01)

(52) U.S. Cl.
CPC ..... *A63H 18/06* (2013.01); *A63H 18/026* (2013.01); *A63H 33/003* (2013.01)

(58) Field of Classification Search
CPC ..... A63H 18/00; A63H 18/02; A63H 18/026; A63H 18/06; A63H 33/003
See application file for complete search history.

(56) References Cited

U.S. PATENT DOCUMENTS 3,013,726 A * 12/1961 Orel ..... A63H 18/02 238/10 E
3,703,989 A * 11/1972 Tomiyama ..... A63H 18/04 238/10 E
4,349,983 A * 9/1982 Kilroy ..... A63H 17/00 446/76
4,505,686 A * 3/1985 Mariol ..... A63H 33/003 446/478
RE32,106 E * 4/1986 Lemelson ..... A63H 18/14 238/10 F
5,683,298 A * 11/1997 Jackson ..... A63H 18/02 463/58
5,813,351 A * 9/1998 Chen ..... A63H 18/02 191/22 R
5,890,948 A * 4/1999 Nilsson ..... A63H 33/044 14/2.4

(Continued)

FOREIGN PATENT DOCUMENTS

GB 2525278 A * 10/2015 ..... A63H 17/44

OTHER PUBLICATIONS

Fisher-Price Little People Sit 'n Stand Skyway, https://www.fisher-price.com/en-ca/product/little-people-sit-n-stand-skyway-hbd77, Jan. 24, 2022, 18 pages.

(Continued)

*Primary Examiner* — Eugene L Kim
*Assistant Examiner* — Alyssa M Hylinski
(74) *Attorney, Agent, or Firm* — Edell, Shapiro & Finnan, LLC

(57) ABSTRACT

A track set including a reconfigurable trackway for a toy vehicle is disclosed. The reconfigurable trackway includes a first track piece defining a first track, and a second track piece defining a second track and a third track that is disposed opposite the second track. The first track piece and the second track piece are configurable in a tower configuration where the first track and the second track define a continuous pathway. The first track piece and the second track piece are configurable in a racing configuration where the second track defines a first racing pathway and the third track defines a second racing pathway, separate from the first racing track.

20 Claims, 4 Drawing Sheets

(56) References Cited

U.S. PATENT DOCUMENTS

| | | | | |
|---|---|---|---|---|
| 7,614,931 | B2 * | 11/2009 | Nuttall | A63H 18/026 446/423 |
| 7,618,302 | B2 * | 11/2009 | Collins | A63H 18/02 446/168 |
| 8,298,038 | B2 * | 10/2012 | O'Connor | A63H 18/04 446/444 |
| 2003/0024940 | A1 * | 2/2003 | Coleman | G07F 11/36 221/24 |
| 2011/0081825 | A1 * | 4/2011 | Jourdian | A63H 18/02 238/10 R |

OTHER PUBLICATIONS

Disney Pixar Cars Rust-eze Racing Tower Playset, https://www.target.com/p/disney-pixar-cars-rust-eze-racing-tower-playset . . . , Jan. 24, 2022, 3 pages.

* cited by examiner

Single lane speed run mode

RECONFIGURABLE TOY VEHICLE TRACK SET

FIELD OF INVENTION

The present invention relates to the field of toy vehicles and, in particular, to a trackway for toy vehicles that can be configured in multiple configurations.

BACKGROUND

Toy vehicles continue to be popular products. Track pieces and track sets for use with toy vehicles may be set up to define trackways. The trackways may be open or closed looped. The toy vehicles used on the trackways can be free-wheeling unpowered vehicles or vehicles which utilize an on-board power drive mechanism. Generally, track pieces may be connected together and with play sets to create a trackway in multiple configurations. However, often, toy vehicle track sets are not reconfigurable. Greater flexibility in the configuration of toy vehicle track sets may be desirable, for example, to increase or extend the play value of a track set.

SUMMARY

The present invention relates to a reconfigurable track set for a toy vehicle. In accordance with at least one embodiment of the present invention, the track set includes a reconfigurable trackway for a toy vehicle including: a rotatable track portion and a base portion. The rotatable track portion includes a first sidewall, a second sidewall, a first surface, and a second surface opposite the first surface. The first surface and the second surface are each disposed between the first and second sidewalls. The base track portion includes a third sidewall, a fourth sidewall, and an upper surface disposed between the third and fourth sidewalls. The first surface, the first sidewall, and the second sidewall define a first pathway, the third sidewall, the fourth sidewall, and the upper surface define a second pathway, and the second surface, the first sidewall, and the second sidewall define a third pathway. The rotatable track portion is rotatable with respect to the base track portion. In a tower configuration, the rotatable track portion is configured to continuously guide the toy vehicle from the first pathway to the second pathway of the base track portion. In a racing configuration, the second pathway and the third pathway have non-overlapping starting positions and ending positions.

In some aspects, the reconfigurable trackway further includes a frame for supporting the trackway, the frame including: a first support including a first base support portion and a first rotatable support portion; and a second support including a second base support portion and a second rotatable support portion. The first and second base support portions are configured to support the base track portion, and the first and second rotatable support portions are configured to support the rotatable track portion.

In some aspects, the techniques described herein relate to a reconfigurable trackway for a toy vehicle including: a first track piece defining a first track; and a second track piece defining a second track and a third track that is disposed opposite the second track. The first track piece and the second track piece are configurable in a tower configuration where the first track and the second track define a continuous pathway. The first track piece and the second track piece are further configurable in a racing configuration where the second track defines a first racing pathway and the third track defines a second racing pathway, separate from the first racing track.

In some aspects, the techniques described herein relate to a reconfigurable track set for toy vehicles, including: a base track portion defining a first track; and a double sided track portion that is movable with respect to the base track portion. The double sided track portion defines a second track and a third track on a reverse side of the double sided track portion. In a first configuration, the first track and the second track form a continuous pathway and, in a second configuration, the first track and the third track define separate pathways.

BRIEF DESCRIPTION OF THE DRAWINGS

To complete the description and in order to provide for a better understanding of the present invention, a set of drawings is provided. The drawings form an integral part of the description and illustrate an embodiment of the present invention, which should not be interpreted as restricting the scope of the invention, but just as an example of how the invention can be carried out. The drawings comprise the following figures.

DETAILED DESCRIPTION

The following description is not to be taken in a limiting sense but is given solely for the purpose of describing the broad principles of the invention. Embodiments of the invention will be described by way of example, with reference to the above-mentioned drawings showing elements and results according to the present invention.

Generally, the toy vehicle track set presented herein is or includes a trackway that is reconfigurable between a first configuration and second configuration by rotating a single portion of the assembly. Thus, a child can handle the reconfiguration relatively easily. In the first configuration, the track set defines a single-lane, continuous pathway for a toy vehicle. In the second configuration, the track set defines two pathways, each having a separate pathway for a toy vehicle. That is, the second configuration is a racing arrangement for guiding two vehicles along different pathways. Thus, the vehicles may race one another down their respective pathways.

The track set can be reconfigured between the first configuration and the second configuration by rotating a first portion of the track set about a second portion. For example, the track set may include a rotatable portion and a base portion. The rotatable portion includes a double sided rotatable track and is operatively coupled to the base portion via a pivot. In the first configuration, the rotatable portion and the base portion form or define a continuous, single-lane pathway to carry or guide a toy vehicle. Then, the rotatable portion can be rotated about the pivot to reconfigure the track set into the second configuration. In the second configuration, the rotatable portion and the base portion are disposed side-by-side, and define two pathways for guiding or carrying toy vehicles. Accordingly, a user can quickly and easily reconfigure the track set from a first configuration to a second configuration by rotating a single portion of the track set.

Figure 1:
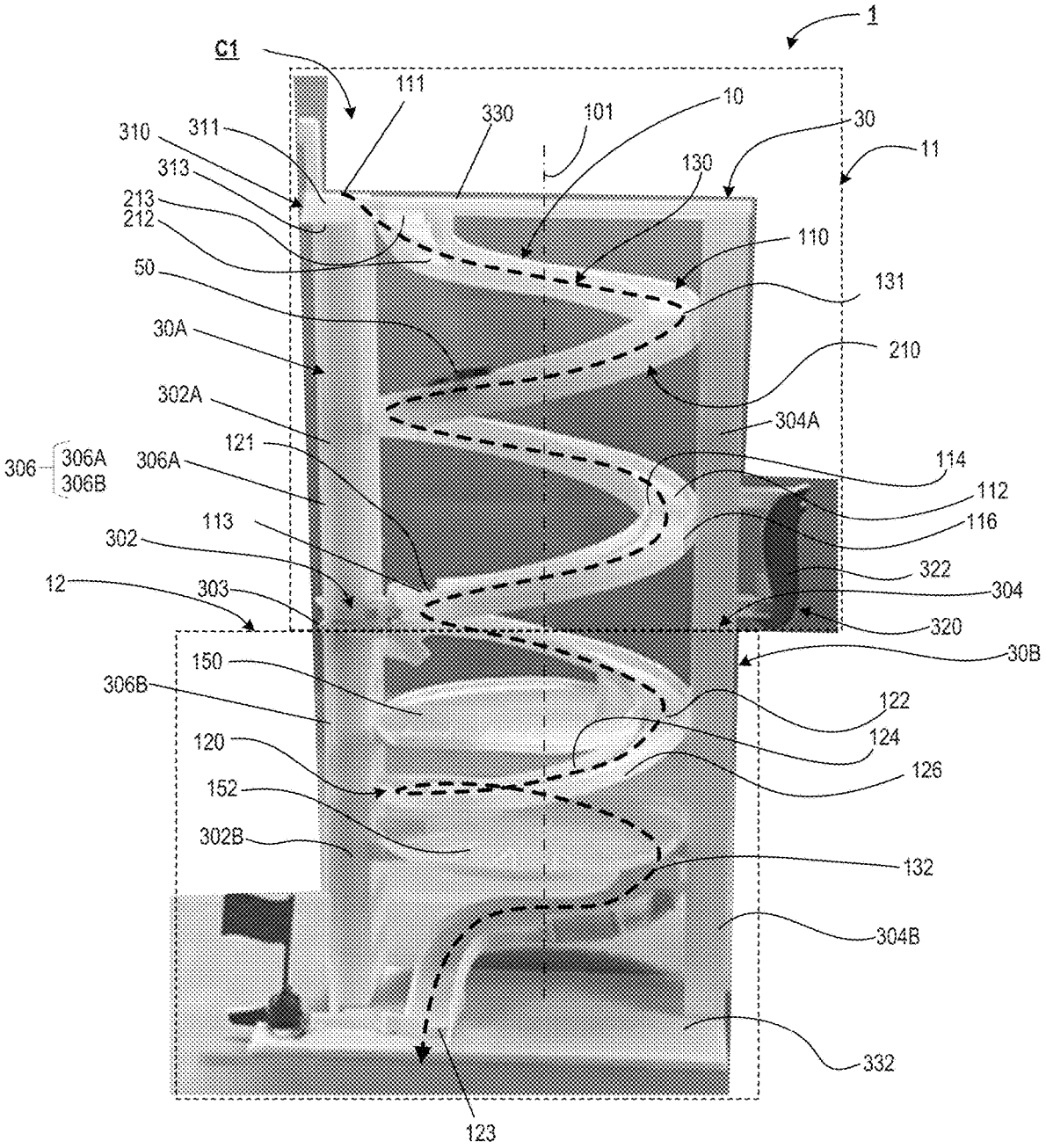
FIG. 1 is a front perspective view of a toy vehicle track set in a first configuration, according to an embodiment.

Now referring to FIG. 1, a reconfigurable track set 1 for defining a trackway for a toy vehicle 50 is illustrated in a first or tower configuration C1. Overall, the track set 1 includes a rotatable portion 11 (i.e., a first track piece 11) and a base portion 12 (i.e., a second track piece 12). For clarity, the rotatable portion 11 and the base portion 12 are each shown within dashed boxes in FIG. 1 to distinguish the two portions 11 and 12 from each other, but these dashed boxed are merely provided as references and form no part of track set 1. As is shown, in the tower configuration C1, the rotatable portion 11 and the base portion 12 cooperate to define a track 10 and a frame 30. More specifically, the rotatable portion 11 sits atop the base portion 12 and is movable with respect to the base portion 12. Meanwhile, the track 10 extends helically along a base axis 101, and defines a pathway 130 for a toy vehicle 50 to travel along. However, embodiments are not limited to helically shaped tracks and, in different implementations, the track 10 may have any desired shape.

As is shown in FIG. 1, the rotatable portion 11 includes a first track 110 supported by a movable or rotatable frame 30A. The first track 110 is double-sided and, thus, includes a first surface 112 and an opposite third surface 212 (see FIG. 2). The second surface 212 is described in further detail below, but the first surface 112 is disposed between a first sidewall 114 and a second sidewall 116. The first and second sidewalls 114 and 116 extend perpendicularly from the first surface 112 in two directions (e.g., upwards and downwards) such that the first surface 112 bisects the first and second sidewalls 114 and 116. That is, the first and second sidewalls 114 and 116 extend above and below the first surface 112 to define a double sided track. In the depicted embodiment, the first track 110 extends helically along base axis 101 from a first starting portion 111 to a first ending portion 113 of the rotatable portion 11 and defines a first pathway 131.

The rotatable frame 30A that supports the first track 110 comprises a first support 302A and a second support 304A, opposite the first support 302A, extending from a rotatable tile 330. In the depicted embodiment, the first track 110 is disposed between and fixed to the first and second supports 302A and 304A. Thus, the first and second supports 302A and 304A support the first track 110. Moreover, the first starting portion 111 may be aligned with and disposed just above the first support 302A.

Still referring to FIG. 1, the base portion 12 includes a second track or base track 120 supported by a base frame 30B. The second track 120 includes a second surface 122 disposed between a third sidewall 124 and a fourth sidewall 126 that each extend perpendicularly from the second surface 122. That is, the third and fourth sidewalls 124 and 126 extend above the second surface 122. The second track 120 extends helically along the base axis 101 from a second starting portion 121 to a second ending portion 123 of the base portion 12 to define a base pathway 132. The base portion 12 further includes parking decks 150 and 152 for storing one or more vehicles 50. The parking decks 150 and 152 may be connected to the second track 120 via ramps. In some implementations, the parking decks 150 and 152 may be omitted without disrupting the continuous pathway 130.

The base frame 30B that supports the second track 120 comprises a first base support 302B and a second base support 304B, opposite the first base support 302B, extending from a base tile 332. In the depicted embodiment, the second track 120 and the parking decks 150 and 152 are disposed between and fixed to the first and second base supports 302B and 304B. Thus, the first and second base supports 302B and 304B support the second track 120 and the parking decks 150 and 152. However, in other embodiments, the second track 120 could be supported in any desirable manner (e.g., with freestanding stanchions or supports).

With the track set 1 arranged in the tower configuration C1, the rotatable portion 11 is vertically aligned with the base portion 12 to define the frame 30 and the track 10. As such, the track 10 forms a continuous pathway 130 extending from the first starting portion 111 to the second ending portion 123.

More specifically, the pathway 130 begins at the first starting portion 111 and extends along the first pathway 131 to the first ending portion 113 of the first track 110. Then, the pathway 130 continues to extend from the first ending portion 113 of the first track 110, past the second starting portion 121 along the base pathway 132 to the second ending portion 123 of the second track 120. That is, the first ending portion 113 of the first track 110 may overlap with a portion the second starting portion 121 of the second track 120. Consequently, the first track 110 and the second track 120 substantially define a continuous helical pathway 130 (comprising at least portions of the first and base pathways 131, 132) for guiding a toy vehicle 50 from the first starting portion 111 to the second ending portion 123. In some implementations, the first ending portion 113 may be pivotably coupled to the first track 110. Consequently, the first ending portion 113 can conform to the second track 120 in the tower configuration C1 and pivot away from the third surface 212 in the second configuration C2.

Additionally, when the track set 1 is in the tower configuration C1, the frame 30 is defined by the rotatable frame 30A and the base frame 30B. In particular, the supports 302A, 302B, 304A, and 304B define continuous vertical frame supports 302 and 304, respectively. That is, the frame 30 comprises a first frame support 302 and a second frame support 304 that supports the track 10 in the tower configuration C1. The first frame support 302 comprises the rotatable first support 302A and the first base support 302B. Meanwhile, the second frame support 304 comprises the rotatable second support 304A and the base second support 304B.

In the depicted embodiment, the first frame support 302 also includes a rail 306 for guiding a toy vehicle elevator 310. The rail 306 guides the elevator 310 along at least a portion of the distance between the base tile 332 and the rotatable tile 330, where the first starting portion 111 is disposed. The depicted rail 306 includes a rotatable rail portion 306A and a base rail portion 306B so that the rail 306 can traverse the rotatable first support 302A and the first base support 302B. The elevator 310 includes a first surface 311 and a second surface 313, opposite the first surface 311, disposed between a pair of sidewalls. The first surface 311 and the pair of sidewalls define a slot for holding the toy vehicle 50. Thus, a user may slide or traverse the elevator 310 along a length of the rail 306 to lower or raise the toy vehicle 50 disposed in the elevator 310.

Although not shown, if the track set 1 is reconfigured into in the second configuration C2 while the elevator 310 is disposed on the rotatable first support 302A, the elevator 310 may be flipped upside-down. Thus, the second surface 313 of the elevator 310 and sidewalls may receive the toy vehicle 50 when the track set 1 is in the second configuration C2 and the elevator 310 is used along the rotatable rail portion 306A. In fact, in some embodiments, the second surface 313 of the elevator 310 may be arranged to hold or carry the toy vehicle 50 so that the track set 1 can be moved from the first configuration C1 to the second configuration C2 while a toy vehicle is disposed on the elevator 310.

Figure 2:
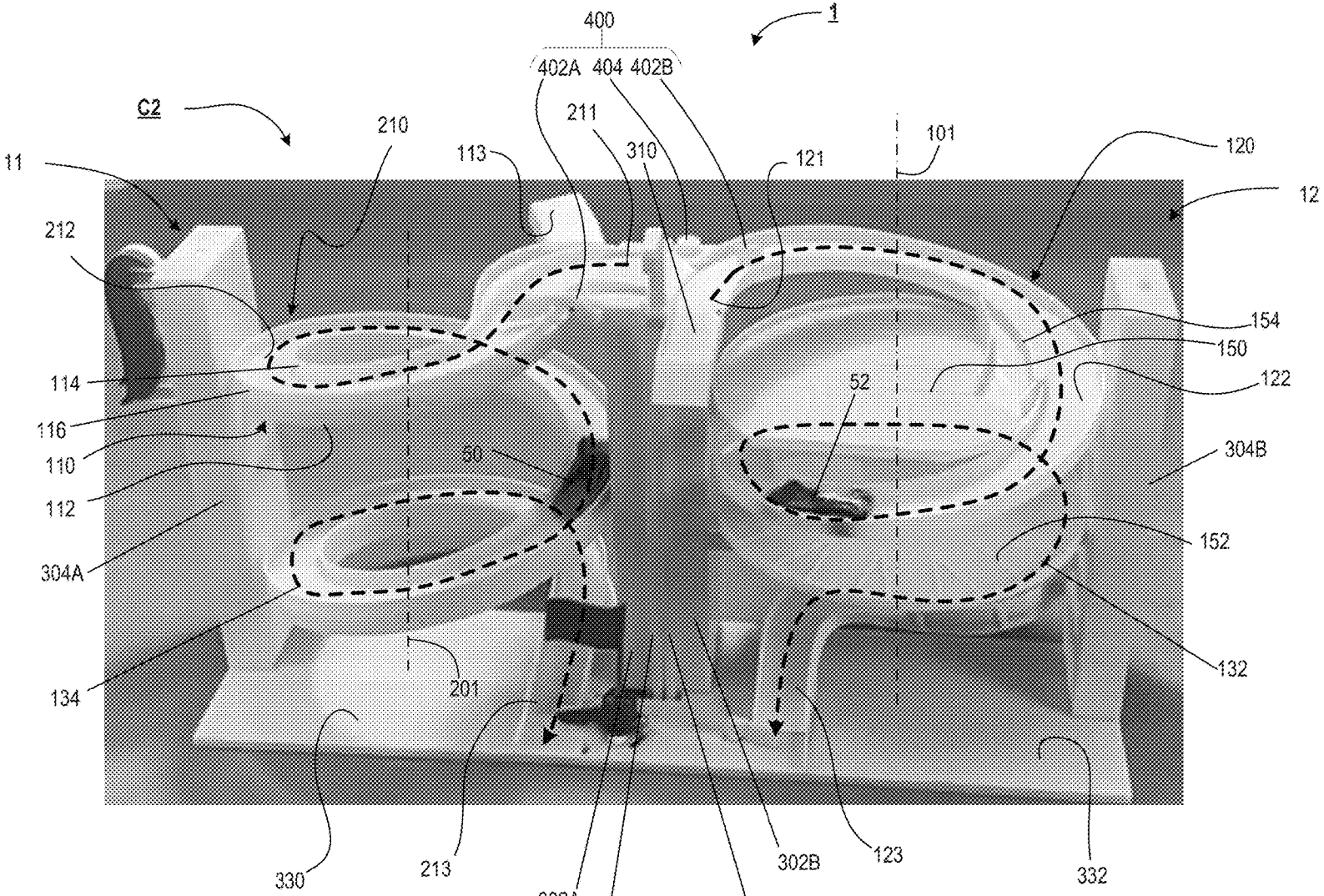
FIG. 2 is a front perspective view of the track set of FIG. 1 in a second configuration.

Now referring to FIGS. 1 and 2, to place the track set 1 into the second configuration C2, the rotatable portion 11, including the rotatable rail portion 306A and elevator 310 (when disposed on the rotatable rail portion 306A), pivots approximately 180° about a hinge 303. The pivot or hinge 303 operatively couples the rotatable portion 11 to the base portion 12. Thus, in the depicted embodiment, the hinge 303 is disposed between the rotatable first support 302A and the first base support 302B and operably couples the rotatable frame 30A to the base frame 30B. Specifically, the hinge 303 serves as a pivot that allows the rotatable portion 11 to rotate about the hinge 303, and thus, about the base portion 12. That is, the rotatable portion 11 is capable of pivoting about the hinge 303 between the first or tower configuration C1 and the second configuration C2. Further, the hinge 303 prevents linear translation of the rotatable portion 11 with respect to the base portion 12.

In the depicted embodiment, the track set 1 also includes a locking mechanism 320 that can lock the track set 1 in the tower configuration C1. The locking mechanism 320, in conjunction with the hinge 303, can fix the rotatable portion 11 to the base portion 12. In the depicted embodiment, the locking mechanism 320 includes a handle 322 operably coupled to the second support 304A of the rotatable portion 11. Operating the handle 322 disengages a latch disposed in the rotatable second support 304A, disengaging the latch from a catch disposed in the second support 304B of the base portion 12. Thus, the locking mechanism 320 and the hinge 303 cooperate to lock the track set 1 in the tower configuration C1 until the handle 322 is actuated to release the locking mechanism 320 and the rotatable portion 11. However, other embodiments need not include a handle 322 or latch and the locking mechanism 320 can engage and disengage the base portion 12 and rotatable portion in any manner.

In some implementations, the locking mechanism 320 may be an automatic locking mechanism. For example, the rotatable portion 11 may include a latch and the base portion 12 may include a catch configured to receive and automatically lock the latch in place. That is, when the track set 1 is reconfigured from the race configuration C2 to the tower configuration C1, the latch engages the catch and the catch automatically locks the latch in place and the rotatable portion 11 in the tower configuration C1. The catch may release the latch in response to an actuation of a knob (e.g., a rotation or translation of the knob). When the latch is released, the track set 1 is unlocked and can be reconfigured back to the race configuration C2. However, a latch and catch are only one example and various embodiments may include any locking mechanism formed from components or parts of any locking systems/assemblies that are now known or developed hereafter, whether automatic or not (e.g., detent locks and buttons or dials, resilient snap locks, etc.).

Now referring to FIG. 2, the track set 1 is depicted in the second or racing configuration C2. In the racing configuration C2, the rotatable portion 11 is disposed next to the base portion 12. A mentioned above, the rotatable portion 11 includes a double sided track that defines another toy vehicle pathway on a reverse side of the track 110 when the rotatable portion 11 is rotated approximately 180° from its position in the first configuration C1. That is, the rotatable portion 11 pivots approximately 180° about the base portion 12 until it is side-by-side with the base portion 12 to simultaneously guide, or race, two vehicles 50, 52 along two separate pathways 132, 134 of the track set 1 with non-overlapping starting positions and/or ending positions.

The second, or base pathway 132 is defined by the second track 120, and a third pathway 134 is defined by a third track 210 of the rotatable portion 11, opposite the first track 110. Said another way, the third track 210 defined by a reverse side of the first track 110. The third track 210 is defined by a third surface 212 of the first track 110 (opposite the first surface 112 of the first track 110) and the sidewalls 114 and 116 of the first track 110. That is, the third track 210 is defined by the first and second sidewalls 114 and 116 and the third surface 212 opposite the first surface 112. In the tower configuration C1, the first track 110 is oriented as an upper track and the third track 210 is oriented upside-down. Meanwhile, in the racing configuration C2, the third track 210 is oriented as an upper track and the first track 110 is oriented upside-down. Thus, the rotatable portion 11 includes two tracks 110 and 210, defined by the first and second sidewalls 114 and 116, and the first and third surfaces 112 and 212, respectively.

The third track 210 substantially mirrors the first track 110, and extends helically along a second axis 201 (substantially parallel to the base axis 101) from a third starting portion 211 to a third ending portion 213. However, in the depicted embodiment, the third starting portion 211 deviates from the first ending portion 113. That is, the first ending portion 113 and the third starting portion 211 are not vertically aligned. Additionally, the third ending portion 213 and the first starting portion 111 are offset (i.e., not vertically aligned).

More specifically, in the racing configuration C2, the first ending portion 113 follows the helical pattern of the first track 110 up and away from the third track 210. In some implementations, the first ending portion 113 is rotatably coupled to the first track 110 and pivots away from the third track 210 in the racing configuration C2 such that it does not obstruct the third pathway 134. Meanwhile, the third starting portion 211 curves in a direction opposite the first track 110, before curving back into the helical shape defined by the rest of the third track 210. Similarly, as depicted in FIG. 1, the first starting portion 111 is vertically aligned with the rotatable support 302A, while, as depicted in FIG. 2, the third ending portion 213 is horizontally offset from the rotatable support 302A and aligned with the rotatable tile 330. However, embodiments are not limited thereto and in other embodiments, the first and third tracks 110 and 210 may be arranged in any desired shape and the starting and ending portions 111, 211, 113, and 213 may be arranged and/or aligned in any desired manner. For example, the first track 110 and the third track 210 may be entirely aligned.

In at least some embodiments, the track set presented herein may include a finish gate and/or some indication of a "winner." For example, the track set 1 may include a two-sided flag gate with levers that extend into ending portions 211 and 213 and these levers may be configured to cause a flag or other such indicator to fall towards the lever that is actuated first (e.g., by a toy vehicle that "wins" a race). Additionally or alternatively, the track set 1 may include any desirable play features now know or developed hereafter.

In the racing configuration C2, the third track 210 is supported by the rotatable frame 30A and the rotatable tile 330. Specifically, the third track 210 is disposed between and supported by the first and second rotatable supports 302A and 302B extending from the rotatable tile 330. Meanwhile, the second track 120 is supported by the base frame 30B and base tile 332 in a similar manner as in the tower configuration C1, described above. In some implementations, the rotatable tile 330 and the base tile 332 may engage one another to lock the track set 1 in the racing configuration C2. For example, the tiles 330 and 332 may include a tongue and groove arrangement that engage one another with an interference fit. Consequently, a side of the first rotatable support 302A abuts a side of the first base support 302B.

The track set 1 may further include a starting mechanism 400 for simultaneously releasing first and second toy vehicles 50 and 52. In the depicted embodiment, the starting mechanism 400 includes a first gate 402A, a second gate 402B, and an actuator 404. The first gate 402A is disposed at the top of the third track 210 and is configured to hold the toy vehicle 50 at the third starting portion 211 by blocking the third pathway 134. The second gate 402B is disposed at the top of the second track 120 and is configured to hold the toy vehicle 52 at the second starting portion 121 by blocking the second pathway 132. The actuator 404 is configured to simultaneously open the first and second gates 402A and 402B and release the first and second vehicles 50 and 52. As an example, FIG. 2 shows the first toy vehicle 50 traveling down the third path 134 along the third track 210 and the second toy vehicle 52 traveling down the second path 132 along the second track 120.

In the depicted embodiment, actuator 404 is a push button and the first gate 402A pivots in response to actuation of the actuator 404, thereby releasing the first toy vehicle 50. Meanwhile, the second gate 402B is a pillar that extend from the second surface 122 and retracts to or below the second surface 122 in response to actuation of the actuator 404, thereby releasing the second toy vehicle 52. Because the actuator 404 activates both gates 402A and 402B simultaneously, the toy vehicles 50 and 52 simultaneously release and race when the actuator 404 is depressed. However, in other embodiments, the track set 1 can include any desirable starting mechanism 400 (e.g., with non-synchronized gates/stops/etc.) or need not include a starting mechanism. Moreover, when the track set 10 includes a starting mechanism 400, pathway 130 of the tower configuration C1 may bypass the starting mechanism 400 so that the gates 402A and 402B do not obstruct the track 10.

Still referring to FIG. 2, the second track 120 further includes one or more diverters 154 for diverting one or more toy vehicles 50, 52 from the second track 120 to the parking decks 150 and 152. In some implementations, the parking decks 150 and 152 and diverters 154 may be omitted. In some implementations, the second track 120 and third track 210 may not be helical. In some implementations, the second track 120 and third track 210 may be serpentine, or otherwise tortuously shaped, and/or include one or more vertical loops.

Figure 3B:
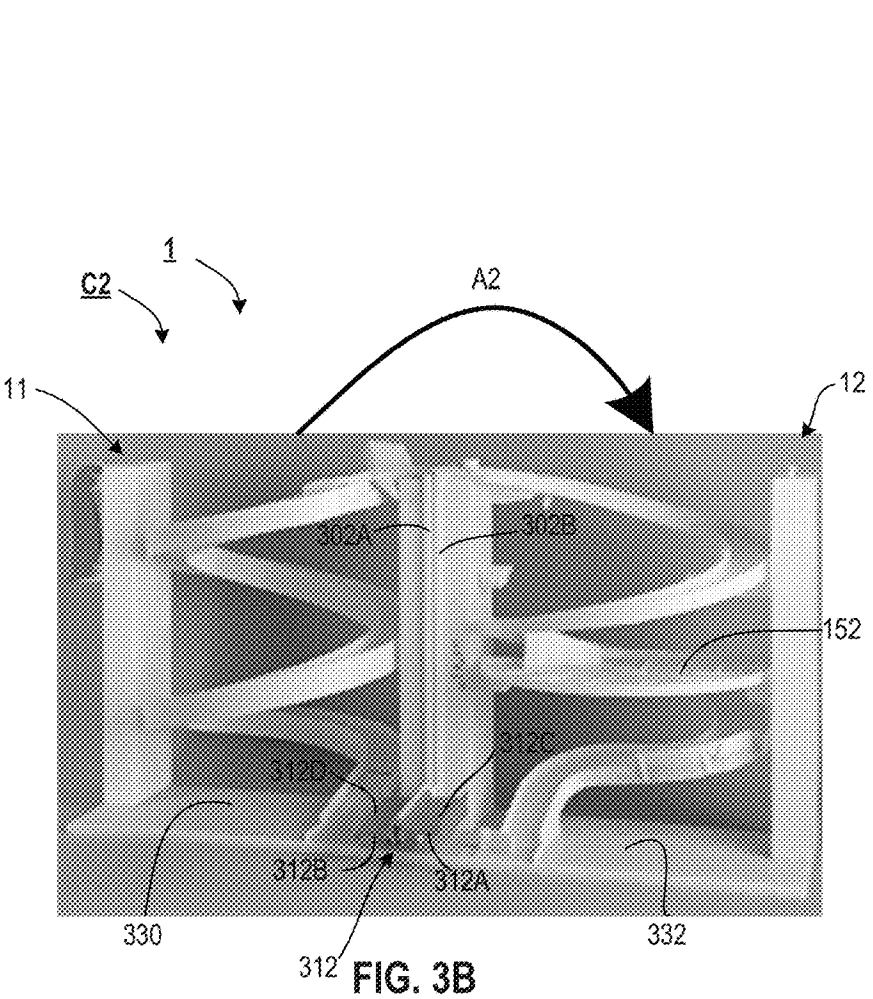
FIG. 3B is a front perspective view of the track set of FIG. 3A in a second configuration.
Figure 3A:
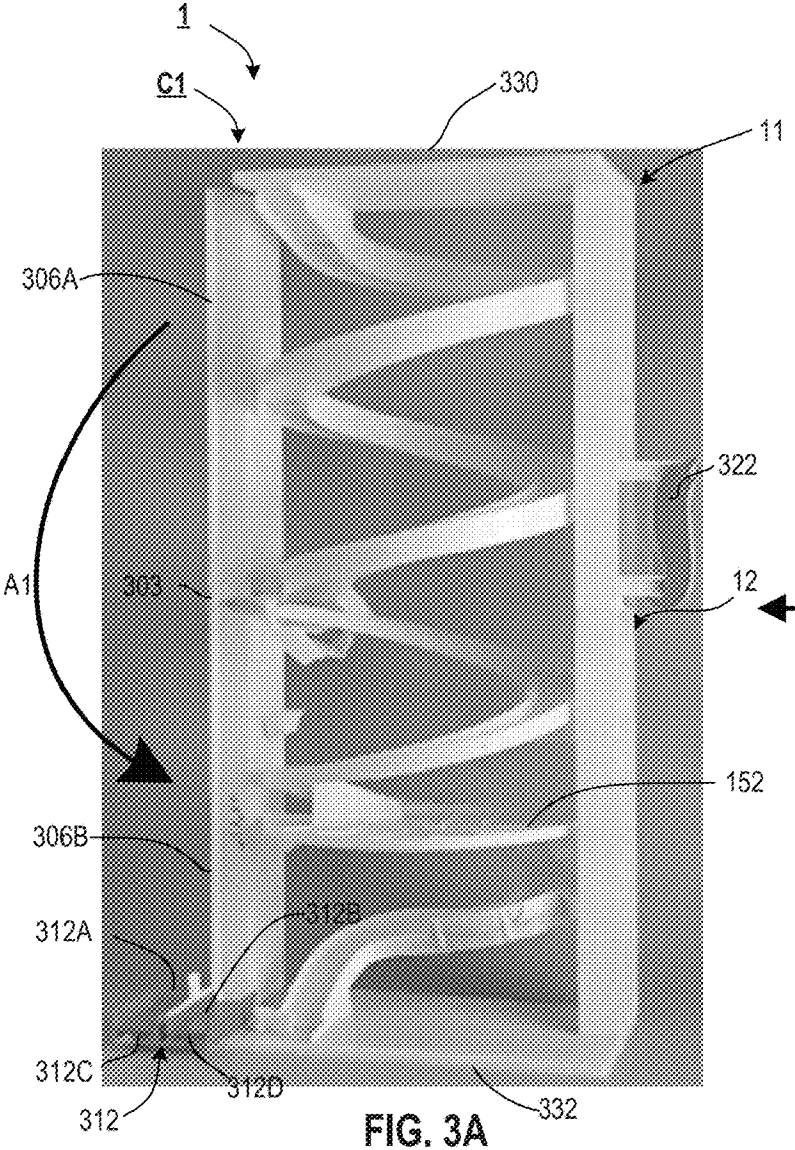
FIG. 3A is a front perspective view of a toy vehicle track set according to another embodiment.

Now referring to FIGS. 3A and 3B, a method of reconfiguring the track set 1 between the tower configuration C1 and the racing configuration C2 by adjusting a single portion of the track set 1 (e.g., rotatable portion 11) is illustrated. Parking deck 150 has been omitted for clarity. Starting in the tower configuration C1, the handle 322 is actuated causing the latch to release the catch in the base portion 12. The rotatable portion 11 pivots about the hinge 303 along arrow A1 until it is horizontally aligned with the base portion 12, as shown in FIG. 3B. The rotatable tile 330 may engage the base tile 332 to maintain the track set 1 in the racing configuration C2. To reconfigure the track set 1 from the racing configuration C2 to the tower configuration C1, the rotatable portion 11 pivots about the hinge 303 along arrow A2 until it is vertically aligned with the base portion 12 as shown in FIG. 3A. The locking mechanism 320 may couple the rotatable portion 11 to the base portion 12 to lock the track set 1 in the tower configuration C1.

Still referring to FIGS. 3A and 3B, the depicted track is generally similar to the track set 1 of FIGS. 1 and 2 (and, thus, is labeled with like reference numerals), but the track set 1 of FIGS. 3A and 3B includes a double sided elevator 312 according to a second embodiment. The double sided elevator 312 includes four slots each having a receiving surface 312A-312D configured to receive a toy vehicle 50 and 52.

Surfaces 312A and 312B are substantially co-planar. Surfaces 312C and 312D are also co-planar and are disposed opposite surfaces 312A and 312B, respectively. In FIG. 3A, the elevator 312 is disposed on the base rail 306B, and surfaces 312A and 312B are oriented facing upwards and configured to each receive a toy vehicle. In FIG. 3B, the elevator 312 is disposed on the rotatable rail 306A and surfaces 312A and 312B are oriented facing downwards. Meanwhile, surfaces 312C and 312D are oriented facing upwards and each configured to receive a toy vehicle. However, the elevator 312 may also remain on rail 306B with the track set 1 in the second configuration C2 and, thus, and surfaces 312A and 312B may remain oriented upwards in configuration C2. Regardless, in either configuration C1 or C2, a user may slide the elevator 312 along a length of either rail portion 306A, 306B to lower or raise one or two toy vehicles 50, 52 to starting portions 111, 121, 211, and/or garage decks 150, 152.

Figure 4B:
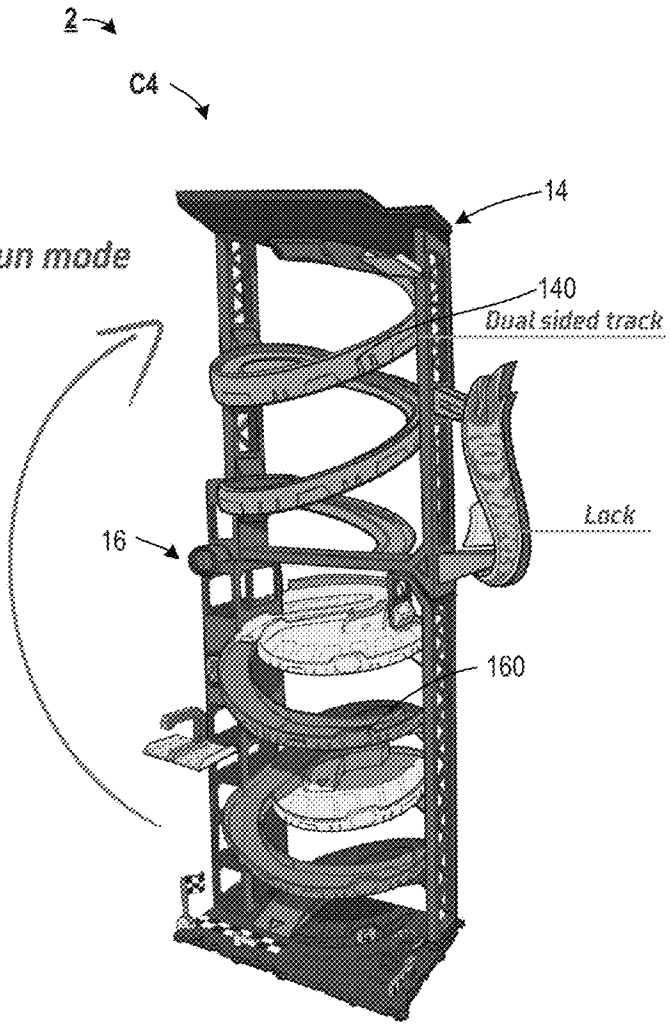
FIG. 4B is a front perspective view of the track set of FIG. 4A in a second configuration.
Figure 4A:
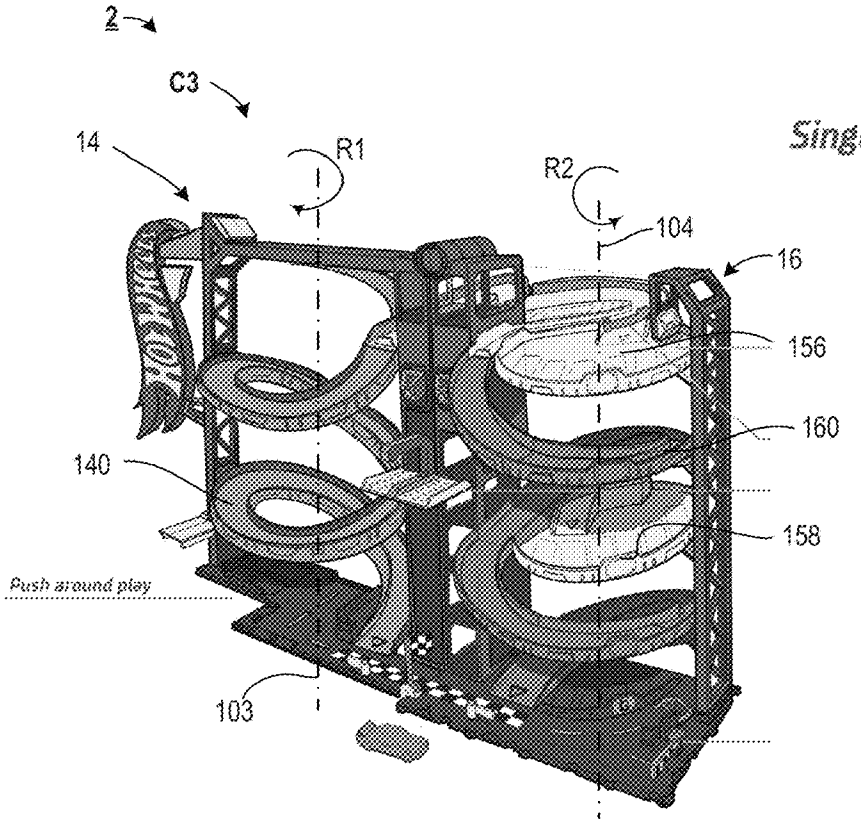
FIG. 4A is a front perspective view of a toy vehicle track set according to another embodiment.

Now referring to FIGS. 4A and 4B, a track set 2 according to another embodiment is depicted. The track set 2 can be reconfigured between a first or racing configuration C3 (depicted in FIG. 4A) and a second or tower configuration C4 (depicted in FIG. 4B). In the depicted embodiment, the track set 2 includes a rotatable portion 14 having a double sided rotatable track 140 and a base portion 16 having a base track 160 with parking decks 156 and 158. The track set 2 is substantially similar to track set 1, however, the rotatable track 140 and the base track 160 have different arrangements and/or appearances. Consequently, for brevity, only the differences between track set 1 and track set 2 are discussed.

Specifically, the double sided rotatable track 140 and the base track extend helically in opposite directions. That is, the rotatable track 140 extends helically about a first axis 103 in a first direction of rotation R1, while the base track 160 extends helically about a second axis 104, parallel to the first axis, in a second direction of rotation R2, opposite the first direction R1. Additionally, the parking decks 156 and 158 are disposed at different levels of the base track 160.

Accordingly, a track set 1, 2, can be reconfigured between two configurations C1 and C2, or C3 and C4, to define a single lane pathway 130, or racing pathways 132 and 134 for guiding one or more toy vehicles 50, 52.

While the invention has been illustrated and described in detail and with reference to specific embodiments thereof, it is nevertheless not intended to be limited to the details shown, since it will be apparent that various modifications and structural changes may be made therein without departing from the scope of the inventions and within the scope and range of equivalents of the claims. In addition, various features from one of the embodiments may be incorporated into another of the embodiments. Accordingly, it is appropriate that the appended claims be construed broadly and in a manner consistent with the scope of the disclosure as set forth in the following claims.

It is also to be understood that the track set described herein, or portions thereof, may be fabricated from any suitable material or combination of materials, such as plastic, foamed plastic, wood, cardboard, pressed paper, metal, supple natural or synthetic materials including, but not limited to, cotton, elastomers, polyester, plastic, rubber, derivatives thereof, and combinations thereof. Suitable plastics may include high-density polyethylene (HDPE), low-density polyethylene (LDPE), polystyrene, acrylonitrile butadiene styrene (ABS), polycarbonate, polyethylene terephthalate (PET), polypropylene, ethylene-vinyl acetate (EVA), or the like. Suitable foamed plastics may include expanded or extruded polystyrene, expanded or extruded polypropylene, EVA foam, derivatives thereof, and combinations thereof.

Reference may be made to the spatial relationships between various components and to the spatial orientation of various aspects of components as depicted in the attached drawings. However, as will be recognized by those skilled in the art after a complete reading of the present disclosure, the devices, components, members, apparatuses, etc. described herein may be positioned in any desired orientation. Thus, the use of terms such as "above", "below", "upper", "lower", "top", "bottom", "left," "right," "front," "rear," "side," "height," "length," "width," "interior," "exterior," "inner," "outer" or other similar terms merely describe points of reference and do not limit the present invention to any particular orientation or configuration. When used to describe a range of dimensions and/or other characteristics (e.g., time, pressure, temperature, distance, etc.) of an element, operations, conditions, etc. the phrase "between X and Y" represents a range that includes X and Y.

Further, the term "exemplary" is used herein to describe an example or illustration. Any embodiment described herein as exemplary is not to be construed as a preferred or advantageous embodiment, but rather as one example or illustration of a possible embodiment.

Further, the present disclosure may repeat reference numerals and/or letters in the various examples. This repetition is for the purpose of simplicity and clarity, and does not in itself dictate a relationship between the various embodiments and/or configurations discussed.

When used herein, the term "comprises" and its derivations (such as "comprising", "including," "containing," etc.) should not be understood in an excluding sense, that is, these terms should not be interpreted as excluding the possibility that what is described and defined may include further elements, steps, etc. Meanwhile, when used herein, the term "approximately" and terms of its family (such as "approximate", etc.) should be understood as indicating values very near to those which accompany the aforementioned term. That is to say, a deviation within reasonable limits from an exact value should be accepted, because a skilled person in the art will understand that such a deviation from the values indicated is inevitable due to measurement inaccuracies, etc. The same applies to the similar terms, such as, but not limited to, "about," "around," and "substantially."

As used herein, unless expressly stated to the contrary, use of the phrase "at least one of", "one or more of", "and/or", and variations thereof are open-ended expressions that are both conjunctive and disjunctive in operation for any and all possible combination of the associated listed items. For example, each of the expressions "at least one of X, Y and Z", "at least one of X, Y or Z", "one or more of X, Y and Z", "one or more of X, Y or Z" and "X, Y and/or Z" can mean any of the following: 1) X, but not Y and not Z; 2) Y, but not X and not Z; 3) Z, but not X and not Y; 4) X and Y, but not Z; 5) X and Z, but not Y; 6) Y and Z, but not X; or 7) X, Y, and Z. Further as referred to herein, "at least one of" and "one or more of" can be represented using the "(s)" nomenclature (e.g., one or more element(s)).

Additionally, unless expressly stated to the contrary, the terms "first", "second", "third", etc., are intended to distinguish the particular nouns they modify (e.g., element, condition, node, module, activity, operation, etc.). Unless expressly stated to the contrary, the use of these terms is not intended to indicate any type of order, rank, importance, temporal sequence, or hierarchy of the modified noun. For example, "first X" and "second X" are intended to designate two "X" elements that are not necessarily limited by any order, rank, importance, temporal sequence, or hierarchy of the two elements.

The invention claimed is:

1. A reconfigurable trackway for a toy vehicle comprising:

a rotatable track portion comprising: a first sidewall, a second sidewall, a first surface, and a second surface opposite the first surface, the first surface and the second surface each being disposed between the first and second sidewalls; and a base track portion comprising: a third sidewall, a fourth sidewall, and an upper surface disposed between the third and fourth sidewalls, wherein the first surface, the first sidewall, and the second sidewall define a first pathway, the third sidewall, the fourth sidewall, and the upper surface define a second pathway, and the second surface, the first sidewall, and the second sidewall define a third pathway, wherein the rotatable track portion is pivotably coupled to the base track portion, wherein, in a tower configuration, the rotatable track portion is stacked on the base track portion and configured to continuously guide the toy vehicle from the first pathway to the second pathway of the base track portion, and wherein, in a racing configuration the rotatable track portion is arranged side-by-side with the base track portion, and the second pathway and the third pathway have non-overlapping starting positions and ending positions.

2. The reconfigurable trackway of claim 1, wherein, in the racing configuration, the base track portion extends helically about a first axis and the rotatable track portion extends helically about a second axis parallel to and offset from the first axis.

3. The reconfigurable trackway of claim 1, wherein in the tower configuration, the base track portion and the rotatable track portion extend helically about a first axis.

4. The reconfigurable trackway of claim 1, further comprising an elevator configured to carry the toy vehicle to a starting position of at least one of the base track portion and the rotatable track portion.

5. The reconfigurable trackway of claim 1, further comprising a frame for supporting the trackway, the frame comprising:

a first support comprising a first base support portion and a first rotatable support portion; and a second support comprising a second base support portion and a second rotatable support portion, wherein the first and second base support portions are configured to support the base track portion, and the first and second rotatable support portions are configured to support the rotatable track portion.

6. The reconfigurable trackway of claim 5, wherein the first and second rotatable support portions sit atop the first and second base support portions when the trackway is in the tower configuration.

7. The reconfigurable trackway of claim 5, wherein a side of the first base support portion abuts a side of the first rotatable support portion when the trackway is in the racing configuration.

8. The reconfigurable trackway of claim 5, further comprising an elevator configured to traverse the first base support portion and the first rotatable support portion when the trackway is in the racing configuration or the tower configuration.

9. The reconfigurable trackway of claim 8, wherein the elevator traverses a first path extending along at least a portion of a length of the first base support portion or the first rotatable support portion when the trackway is in the racing configuration and the elevator traverses a second path extending along at least a portion of a combined length of the first base support portion and the first rotatable support portion when the trackway is in the tower configuration.

10. A reconfigurable trackway for a toy vehicle comprising:

a first track piece defining a first track; and a second track piece defining a second track and a third track that is disposed opposite the second track, the second track piece pivotably coupled to the first track piece, wherein the first track piece and the second track piece are configurable in a tower configuration where the first track piece and the second track piece are vertically stacked and the first track and the second track define a continuous pathway, and wherein the first track piece and the second track piece are configurable in a racing configuration where the first track piece and the second track piece are arranged sided-by-side, and the second track defines a first racing pathway and the third track defines a second racing pathway, separate from the first racing pathway.

11. The reconfigurable trackway of claim 10, further comprising a rotatable portion and a base portion.

12. The reconfigurable trackway of claim 11, wherein the first track is disposed in the base portion, and the second and third tracks are disposed in the rotatable portion.

13. The reconfigurable trackway of claim 11, further comprising a hinge operably coupling the rotatable portion and the base portion.

14. A reconfigurable track set for toy vehicles, comprising:

a base track portion defining a first track; and a double sided track portion that is pivotably coupled to the base track portion, the double sided track portion defining a second track and a third track on a reverse side of the second track;

wherein, in a first configuration, the double sided track portion is vertically aligned with the base track portion and the first track and the second track form a continuous pathway and, in a second configuration, the double sided track portion is side-by-side with the base track portion and the first track and the third track define separate pathways.

15. The reconfigurable track set of claim 14, wherein the double sided track portion is configured to rotate about the base track portion.

16. The reconfigurable track set of claim 14, wherein the second track comprises a first surface and the third track comprises a second surface opposite the first surface.

17. The reconfigurable track set of claim 14 further comprising a movable frame configured to operably support the double sided track portion, and a base frame configured to support the base track portion.

18. The reconfigurable track set of claim 17, wherein in the first configuration, the base frame further supports the movable frame.

19. The reconfigurable track set of claim 17, further comprising a hinge operably coupling the movable frame to the base frame.

20. The reconfigurable track set of claim 14, further comprising an elevator configured to traverse the movable frame and the base frame when the track set is in the first configuration and/or the second configuration.

* * * * *